United States Patent [19]

Brown et al.

[11] Patent Number: 4,474,652

[45] Date of Patent: Oct. 2, 1984

[54] ELECTROCHEMICAL ORGANIC SYNTHESIS

[75] Inventors: David E. Brown, Weybridge; Stephen M. Hall, Richmond; Mahmood N. Mahmood, Walton-on-Thames, all of England

[73] Assignee: The British Petroleum Company p.l.c., London, England

[21] Appl. No.: 578,665

[22] Filed: Feb. 9, 1984

Related U.S. Application Data

[63] Continuation-in-part of Ser. No. 448,359, Dec. 9, 1982, abandoned.

[30] Foreign Application Priority Data

Dec. 11, 1981 [GB] United Kingdom ..... 8137524

[51] Int. Cl.[3] ..... C25B 1/00

[52] U.S. Cl. ..... 204/59 R; 204/75; 204/76

[58] Field of Search ..... 204/59 R, 75, 76; 252/425.3; 429/42

[56] References Cited

U.S. PATENT DOCUMENTS

| | | | |
|---|---|---|---|
| 3,248,267 | 4/1966 | Langer | 429/42 |
| 4,240,882 | 12/1980 | Ang | 204/75 |
| 4,310,393 | 1/1982 | Bell | 204/59 R |

FOREIGN PATENT DOCUMENTS 2069533 8/1984 United Kingdom .

*Primary Examiner*—John F. Niebling

*Attorney, Agent, or Firm*—Brooks, Haidt, Haffner & Delahunty

[57] ABSTRACT

The present invention relates to an electrochemical process for synthesizing carboxylic acids by reduction of gaseous oxides of carbon in which a gas transfer electrode is used as the cathode.

The gas transfer electrodes are preferably used as hydrophobic gas transfer electrodes. In carrying out the process it is particularly preferred to use porous, hydrophobic gas transfer electrodes made from an electrocatalyst e.g. carbon, bound in a polymer such as polyethylene or polytetrafluoroethylene (PTFE). In the case of some reactions another electro-catalyst may be added to the carbon/polymer mixture.

The process is particularly suited to producing acids such as formic acid and oxalic acid.

7 Claims, No Drawings

ELECTROCHEMICAL ORGANIC SYNTHESIS

The present invention relates to an electrode and a method for electrochemical synthesis of organic compounds and is a continuation in part of our copending U.S. application Ser. No. 06/448359, filed on Dec. 9, 1982 now abandoned.

Electrochemical methods of synthesising organic compounds are known. For example, aqueous solutions of carbon dioxide can be electrochemically reduced to solutions of formate ions at low current densities. These prior art methods have always employed submerged electrodes and usually require high overvoltage which in turn therefore requires them to compete with one of the following hydrogen evolution reactions.

$$2H_3O^+ + 2e^- — H_2 + 2H_2O \quad \text{(acidic medium)}$$

$$2H_2O + 2e^- — H_2 + 2OH^- \quad \text{(basic medium)}$$

Hence, it is conventional to choose an electrode material on which the rate of hydrogen evolution is slow. Examples of such materials include mercury, lead and thallium. Since the rate of hydrogen evolution is pH dependent, it is also preferred to carry out the process in a neutral medium to minimise the adverse effects of the competitive reactions. Use of neutral media also enhances the solubility of carbon dioxide. A summary of results reported previously is given in Table 1 below together with the relevant references.

carbon characterised in that a gas transfer electrode which is not a photosensitive electrode having a p-type semi-conductor material on the surface thereof is used as the cathode.

Gas transfer electrodes, also referred to as called gas diffusion electrodes, are well known. Hitherto such electrodes have been used for power generation in fuel cells for the oxidation of hydrogen and the reduction of oxygen.

The gas transfer electrodes are used as cathodes in the process of the present invention. Most preferably, the gas transfer electrodes are used as hydrophobic gas transfer electrodes. In carrying out the process of the present invention any of the conventional hydrophobic gas transfer electrodes may be used. It is particularly preferred to use porous, hydrophobic gas transfer electrodes made from an electrocatalyst eg carbon, bound in a polymer such as a polyolefin eg polyethylene, polyvinyl chloride or polytetrafluoroethylene (PTFE). In the case of some reactions another electrocatalyst may be used.

Electro-catalytic mixtures that may suitably be used include carbon/tin (powder) mixtures, carbon/strontium titanate mixtures, carbon/titanium dioxide mixtures and silver powder/carbon mixtures. Graphite may be used in place of carbon in such electro-catalytic mixtures. All these electrocatalysts are rendered hydrophobic by binding in a polymer such as polyethylene or polytetrafluoroethylene (PTFE). The specific catalysts chosen for a given reaction will depend upon the nature

TABLE 1

| Electrode | Reaction Voltage vs SCE | Current Density mA/cm$^2$ | Current Efficiency % HCOOH | pH | Electrolyte | $CO_2$ Pressure Atm | Reference |
|---|---|---|---|---|---|---|---|
| Mercury | −1.5 | 0.01 | 98 | 7 | 0.1 M $NaHCO_3$ | 1 | 1 |
| Mercury | −1.95 | 1.0 | | 7 | 0.1 M $NaHCO_3$ | 1 | 1 |
| Mercury | −1.2 | 0.14 | 8.1 | 1.4 | N/10 LiCl/HCl | 1 | 2 |
| Mercury | −1.7 | 0.59 | 60 | 4.6 | N/5 $CH_3COOLi/CH_3COOH$ | 1 | 2 |
| Mercury | −1.8 | 0.29 | 100 | 6.7 | N/10 $LiHCO_3$ | 1 | 2 |
| Rotating Copper amalgam | −2.4 | 2.0 | 81.5 | 7-9 | 10% $Na_2SO_4$ | 1 | 3 |
| Rotating Copper | −2.4 | 5.0 | 32.8 | 7-9 | 10% $Na_2SO_4$ | 1 | 3 |
| Rotating indium | −1.95 | 20 | 85 | 6 | 0.05 M $Li_2CO_3$ | 10 | 4 |

References:
1 Ryu, J., Anderson, T.N. and Eyring, H., J Phys Chem, 76, 3278, 1972.
2 Paikm W., Anderson, T.N. and Eyring, H., Electrochimica Acta, 14, 1217, 1969.
3 Udupa, K.S., Subramanian, G.S. and Udupa, H.V.K., Electrochimica Acta, 16, 1593, 1971.
4 Ko, K., Ikeda, S. and Okabe, M., Dendi Kagaku Oyobi Kogyo Butsari Kagaky, 48, 247, 1980.
SCE — Saturated Calomel Electrode From the results above it can be seen that the current density realised is dependent on mass transfer of dissolved carbon dioxide to the electrode surface. In the last three references in Table 1 the mass transfer limitation has been eased to some extent and relatively higher current densities achieved by increasing the solubility of carbon dioxide by raising the pressure above the electrolyte and/or by rotating the electrode at high speed. However, neither of these expedients are commercially attractive. Moreover, to make the process economically viable the current densities reported in the first five results in Table 1 at low carbon dioxide pressure must be increased at least by two orders of magnitude and it would also be desirable to reduce the reaction overvoltage.

It has now been found that these problems can be mitigated by using gas transfer electrodes of the type conventionally used in fuel cells.

Accordingly the present invention relates to a non-photoreductive electrochemical process for synthesising carboxylic acids by reduction of gaseous oxides of of the reactants, the electrolyte used and the products desired.

The reactions which may be used to synthesise various organic compounds according to the process of the present invention include reduction of carbon dioxide and carbon monoxide to the corresponding acids, aldehydes and alcohols. Specifically, formic and oxalic acids may be produced by the reduction of carbon dioxide in this manner.

The solvent used as electrolyte for a given reaction will depend upon the nature of the reactants and the products desired. Both protic and aprotic solvents may be used as electrolytes. Specific examples of solvents include water, strong mineral acids and alcohols such as methanol and ethanol which represent protic solvents, and alkylene carbonates such as propylene carbonate which represent aprotic solvents. The solvents used as electrolytes may have other conventional supporting electrolytes eg sodium sulphate, sodium chloride and alkyl ammonium salts such as triethyl ammonium chloride.

The electrolytic reaction is suitably carried out at temperatures between 0° and 100°C.

Taking the specific example of carbon dioxide as a reactant, it is possible to control the reaction to yield a desired product by selecting the appropriate catalyst and electrolyte.

For example, if a carbon/tin catalyst is used in a protic solvent such as ethanol, the major product is formic acid. The carbon/tin electrode produced formic acid at a current density of 149 mA/cm$^2$ with a current efficiency of 83% and an electrode potential of −1644 mV vs SCE. When these results are compared with those of the prior art summarised in Table 1 above, the surprising nature of the invention will be self evident.

The gas transfer electrodes of the present invention may be used either in a flow-through mode or in a flow-by mode. In a flow-through mode sufficient gas pressure is applied to the gas side of the electrode to force gas through the porous structure of the electrode into the electrolyte. In a flow-by mode, less pressure is applied to the gas side of the electrode and gas does not permeate into the electrolyte.

The present invention is further illustrated with reference to the following Examples.

The following Examples were carried out in a three compartment cell comprising a reference Standard Calomel Electrode compartment from which extended a Luggin Capillary into a cathode compartment housing the gas diffusion cathode and an anode compartment housing a platinum anode. The cathode and anode compartments were separated by a cation exchange membrane to prevent reduction products formed at the cathode being oxidised at the anode. The porous gas diffusion cathode was placed in contact with the electrolyte in each case. Analytical grade carbon dioxide was passed on the dry side of the electrode surface.

The PTFE bonded porous gas diffusion cathodes of the present invention were based on carbon. Finely divided Raven 410 carbon (corresponding to Molacco, 23 m$^2$/g medium resistivity from Columbian Carbon, Akron, Ohio, USA) and Vulcan XC72 (230 m$^2$/g conductive carbon black from Cabot Carbons, Ellesmere Port, Cheshire, UK) were used in the Examples. The carbon was slurried with a PTFE dispersion (Ex ICI GPI) and, where indicated, an additional metal or compound, and water. The slurry was pasted onto a substrate which was a lead-plated twill weave nickel mesh. The pasted substrate was cured by heating under hydrogen for one hour at 300° C. unless otherwise stated.

Analyses of carboxylic acid content both in aqueous and in aprotic solutions were done using either ion-exchange liquid chromatography or high performance liquid chromatography.

The details of elecrocatalysts, electrolytes and reaction conditions used and results achieved are shown below. All percentages referred to are by weight.

EXAMPLES 1-4

Electrode Fabrication and Electrochemical Testing

Vulcan XC72 carbon was mixed with an appropriate amount of PTFE dispersion ("Fluon", GP1, from ICI) and distilled water to form a slurry. This slurry was repeatedly applied onto a lead-plated nickel mesh or copper mesh current collector until on visual examination all the perforations were fully covered with the catalyst mixture. After drying in an oven at 100° C. for 10 minutes, the electrode was compacted, using a metal rod which was rolled over the electrode several times until the catalyst mixture was firmly imbedded on the the gauze substrate. The electrode was finally cured under hydrogen at 300° C. for 1 hour.

The resulting electrodes were mounted in a cylindrical glass holder which has a gas inlet and an outlet connected to a water manometer. The holder was then positioned in the cell in a floating mode at a carbon dioxide pressure of about 2 cm of water in order to keep one side of the electrode dry. The electrodes were finally used for electrolysis at a constant potential (shown in Table 2 below) for 90 minutes in aqueous sodium chloride solution (25% w/v) and at room temperature.

TABLE 2

| Example | Weight of Vulcan XC72 carbon (mg/cm$^2$) | Weight of PTFE (mg/cm$^2$) | Constant potential Vs SCE (volts) | Average current density (mA/cm$^2$) | Average current efficiency (%) for formic acid production |
|---|---|---|---|---|---|
| 1 | 34.9 | 42 | −2.00 | 128 | 21.4 |
| 2 | 69.5 | 125.3 | −1.8 | 46 | 36.8 |
| 3 | 87.2 | 41.8 | −1.8 | 102 | 76.1 |
| 4 | 80 | 38.4 | −2.0 | 113 | 40.2 |

EXAMPLE 5

| | |
|---|---|
| Catalyst: | 23.8% Raven 410 Carbon, 28.6% PTFE and 47.6% tin powder (150 microns) |
| Potential: | −1644 vs SCE |
| Current Density: | 150 mA/cm$^2$ |
| Electrolyte: | 5% aqueous solution of sodium chloride |
| pH: | 4–5 at room temperature (22.5° C.) |
| Efficiency: | 83% for formic acid |

EXAMPLE 6

| | |
|---|---|
| Catalyst: | 71.5% Raven 410 Carbon, 28.5% PTFE |
| Potential: | −1767 mV vs SCE |
| Current Density: | 115 mA/cm$^2$ |
| Electrolyte: | 5% aqueous solution of sodium sulphate |
| pH: | 3.5–5 at room temperature (20–22.5° C.) |
| Efficiency: | 43% for formic acid |

We claim:

1. A non-photoreductive electrochemical process for synthesising carboxylic acids by reduction of gaseous oxides of carbon characterised in that a gas transfer electrode which is not a photosensitive electrode having a p-type semi-conductor material on the surface thereof is used as the cathode.

2. An electrochemical process according to claim 1 wherein the electrolyte used is selected from protic and aprotic solvents.

3. An electrochemical process according to claim 1 wherein the gas transfer electrode is a porous, hydrophobic gas transfer electrode made from carbon or graphite mixed with a polymer.

4. An electrochemical process according to claim 3 wherein another electro-catalyst is added to the mixture.

5. An electrochemical process according to claim 4 wherein the electrocatalytic mixture used is selected from carbon/tin power mixtures, carbon/strontium titanate mixtures, carbon/titanium dioxide mixtures and silver powder/carbon mixtures.

6. An electrochemical process according to claim 1 wherein the electrolytic reaction is carried out at temperatures between 0° and 100° C.

7. An electrochemical process according to claim 1 wherein formic acid is produced by the reduction of carbon dioxide.

* * * * *

UNITED STATES PATENT AND TRADEMARK OFFICE

CERTIFICATE OF CORRECTION

PATENT NO. : 4,474,652

DATED : October 2, 1984

INVENTOR(S) : DAVID E. BROWN, STEPHEN M. HALL, MAHMOOD N. MAHMOOD

It is certified that error appears in the above-identified patent and that said Letters Patent is hereby corrected as shown below:

In The Claims - Claim 5, Col. 5, line 1

"power" should read --powder--

Signed and Sealed this

*Twelfth* Day of *March 1985*

[SEAL]

*Attest:*

DONALD J. QUIGG

*Attesting Officer*

*Acting Commissioner of Patents and Trademarks*